United States Patent [19]

Questel

[11] Patent Number: 4,770,400

[45] Date of Patent: Sep. 13, 1988

[54] MULTIPOINT CLAMPING JIG

[76] Inventor: William Questel, 705 Washington St., Portsmouth, Ohio 45662

[21] Appl. No.: 920,380

[22] Filed: Oct. 20, 1986

[51] Int. Cl.[4] ..... B25B 5/14

[52] U.S. Cl. ..... 269/104; 269/147; 269/152

[58] Field of Search ..... 269/104, 105, 147–149, 269/152, 155, 246, 904; 144/256.1; 279/110

[56] References Cited

U.S. PATENT DOCUMENTS

| | | | |
|---|---|---|---|
| 1,546,721 | 7/1925 | Davis | 269/104 |
| 1,783,713 | 12/1930 | Holman | 269/147 |
| 2,360,417 | 10/1944 | Grenfell | 269/904 |
| 2,491,638 | 12/1949 | Ayers | 269/904 |
| 3,080,162 | 3/1963 | Smith | 269/104 |

FOREIGN PATENT DOCUMENTS

| | | | |
|---|---|---|---|
| 655665 | 12/1937 | Fed. Rep. of Germany | 269/104 |

*Primary Examiner*—Robert C. Watson

*Attorney, Agent, or Firm*—Charles A. McCrae

[57] ABSTRACT

This invention is related to wood working, more specifically to repairing wooden and or other materials that have round or oval shapes, that have separated at old glue joints, or that have splintered or split. This invention will preferrably be used in conjunction with one-half or three-quarter inch pipe clamps and/or bar clamps, giving multiple clamping pressure points around any size circumference table top, desk top or any other object, circular or oblong. By using this invention, the object to be repaired can be subjected to the constant pressure needed around it's circumference to insure that a proper permanent bond forms between the separated or damaged pieces of wood or other related materials.

10 Claims, 3 Drawing Sheets

MULTIPOINT CLAMPING JIG

BACKGROUND OF THE INVENTION

In general, repairing a wooden table top or desk top that has been broken, cracked, or splintered, is done by gluing the pieces together and then forcing the two pieces together by means of a clamping arrangement, then, allowing the clamping arrangement to remain in place until a permanent bond is formed. The clamping arrangement generally consists of bar clamps or pipe clamps. These clamps are attached to the opposite edges of the object to be repaired, either a table or desk top, covering the repaired portion. By adjusting the clamping arrangement properly, pressure can be exerted on the glued area, allowing a proper bond to form between the two pieces of wood or other related materials. The clamps are generally approximately three-fourth inch pipe clamps, but can be one-half inch pipe clamps, and have the capability of being adjusted in such a manner that they affect the broken pieces with force, holding the glued, separated pieces together, allowing them to form a permanent bond. The process generally takes about twenty four hours of such pressure.

This general application works very well for objects which are shaped in either square or rectangle form. This is true, no matter how large the object is, since the only impediment is the length of the pipe which holds the clamp ends. For extra long or wide tables or desk, two or more such pipe clamps or bar clamps can be placed side by side, without much difficulty. Each pipe clamp or bar clamp can maintain constant pressure, once the clamps have been properly adjusted on the object being repaired, for the entire period required by the instructions which appear in the directions that are printed on the glue container. The glue can be any commercially available glue, designated for such purposes.

A problem occurs, however, where the shape of the object top to be repaired is round or oval in shape. This creates a difficult situation when trying to use more than one clamping arrangement is needed to secure additional pressure points, at other locations around the object's circumference. These additional clamps slip off the circumference of the object being repaired, when needed pressure is applied, due to the inability of the clamps to stay in position on the curved circumference. Constant pressure is not attainable to complete a permenent bonded glue joint.

The present invention has solved this problem by using a product of manufacture called a multipoint clamping jig. This jig consists of a stationary round base with U shaped indentations around the outside rim, into which the pipe clamps are seated, making multiple pressure points available around the inside circumference of the multipoint clamping jig rim. By using this invention, the pipe clamps are then applying direct straight line pressure from the inside rim of the multipoint clamping jig to the outside circumference of the object top being repaired. This straight line clamping pressure eliminates any and all clamp slippage around the object's circumference, when clamps are tightened for needed constant pressure to complete a permanant glue bond.

The stationary base is round, allowing the pipe clamps to be placed uniformly around the object, table or desk top. By using this invention, along with commercially available glue, table tops and desk tops which have round or oval shapes can be easily repaired.

Prior to this invention, it was necessary to cut wooden glue blocks to match the circumference or shape of the object to be repaired, but have a square edge on the opposite side of the blocks, onto which the bar or pipe clamps could be attached. Then one had to attach the commercially available pipe clamp to the square edge of the glue blocks, to obtain the proper clamping base. This system failed many times because the clamp pressure, when applied would cause block slippage around the curved circumference of the object top being repaired, causing a poor glue bond making the repair job a failure.

The present invention solves this problem, since the base of the jig contains U-shaped indentations around its outer rim, which allows one end of the pipe clamp to be seated into that base rim, supplying multiple positions for direct clamping pressure to the outer circumference edge of the object to be repaired. Using this invention, one is able to maintain constant pressure, on multiple locations around any size circumference without any slippage at the pressure points when the clamps are adjusted to the needed pressure for proper glue joint bonding. There is no loosening due to clamp slippage. This makes a successful job.

SUMMARY OF THE INVENTION

The present invention is notable in providing a simple, relatively straightforward, and easy method for securing two pieces of wood or other related materials which are to be glued together, and which belong to objects that are round or oval in shape. The invention works particularly well where one is attempting to repair antique tables or desk tops having a round or oval shapes. The base of the jig is placed in the center of the object to be repaired, after the glue has been applied, according to the instructions on the glue container. Although it may be necessary to sand the broken pieces, in order to insure that they fit perfectly together, once the fit is made and the glue is applied, one simply seats the pipe clamps into the U-shaped indentation of the rim part of the multipoint clamping jig. This becomes the anchor for the pipe clamps. Now extend the pipe clamps to their proper length to reach the circumference edge of the object top to be repaired (glued). Clamps are now in proper position for tightening.

It is not always necessary to put the pipe clamp arrangement into all the U-shaped indentations, when repairing an object. Occasionally, it is not necessary to clamp the object entirely around its circumference, where only a small portion of the object has been damaged. *It is necessary, however,* that, where a clamp arrangement is used on one side of the base, a clamping arrangement is also used on the countervailing or opposite base position. Considering the base as the face of a clock, if one should place a clamping arrangement, consisting of a pipe clamp on the base, and extend it to the edge of the object to be repaired, at the twelve position, another should also be placed at the six position. Or, where one is placed at the ten position, then another should also be placed at the four (4) position.

Once the clamping arrangement is in place, the clamps are adjusted and tightened to insure that a proper permanent bond will form. The clamping jig is allowed to remain in place until the required time has elasped and a permanent bond is formed.

The base of the jig can be made of cast iron or any other suitable product which has sufficient tensile strength to withstand the pressures created by the clamps being attached to the U-shaped indentations of the base rim when tightened. When the clamps are adjusted, so as to obtain the pressure necessary to assure permanent bonding between the two pieces of wood, a pressure is exerted on the inside of the clamping jig base rim. Even though the pressure is, preferably, distributed equally around the base, if the base does not have sufficient tensile strength, the pressure will pull the base apart before the wood has had sufficient time to form the required bond.

The base contains U-shaped indentations located around its circumference rim. A perferred embodiment of the present invention contains sixteen of such U-shaped indentations. The U-shaped indentations are such as to allow the pipe to fit securely into them, and are placed far enough apart so that the clamp end which attaches to the inside edge of the base rim, can be securely attached to the base rim, without interference from the clamp that is next to it. Ideally, the space between the U-shaped indentations is such that another clamp can be attached between two existing U-shaped indentations, where there is no precut indentation. This is accomplished by turning the clamp end upside down allowing the larger portion of the clamp end to be attached to the inside edge of the base rim or to the edges of neighboring clamps.

DESCRIPTION OF VARIOUS AND PREFERRED EMBODIMENTS

The present invention provides a convenient method for repairing wooden objects which are round or oval in shape, through the use of a multipoint clamping jig. The jig consists of a base, which can be made from any suitable product, and commercially available pipe clamps or bar clamps. The base is preferably made of cast iron, but could also be fabricated from steel, high density plastic, or any other substance which has sufficient tensile strength to withstand being pulled apart when pressure is exerted on the inside edge of the base rim. The diameter of the base is approximately twelve to twenty-four inches, preferably 16 to 20 inches, and more preferably 18 inches. The base contains serial U-shaped indentations along its rim.

The U-shaped indentations, which are made around the circumference of the base rim, are each sufficient for the pipe clamps to fit securely therein. The U-shaped indentations can range from three-quarter inch to one and three-quarter inch, preferably one and one-eighth inch to one and one-quarter inch, and more preferably one and one-eighth inch. Each of such pipe clamps consisting of a pipe having detachable end on one end. On the other end of the clamp is a detachable end which is also adjustable. The adjustable end is attached to the edge of the table top or the object to be repaired.

The adhesive to be used is any commercially available adhesive substance. This substance could be glue, such as that commercially known as Elmer's Furniture Glue, Tite Bond Glue, Animal Glue or any other suitable substitute.

To operate the multipoint clamping jig, one first needs a table top or other object to be repaired, which is broken, splintered or separated and is circular or oblong in shape. The pieces are glued, using any commercial glue. Once properly glued, the base of the jig is placed onto the center of the desk top or in the center of the object to be repaired. Next, the pipe clamps are serially seated into the inside edge of the U-shaped indentations, located on the base rim. Each clamp so placed must have a countervailing pipe clamp on the opposite side of the base. Finally, the pipe clamp is adjusted and tightened, at the edge of the circular or oblong table or object to be repaired, to the pressure required to insure formation of a permanent bond between the pieces of broken wood.

Figure 1:
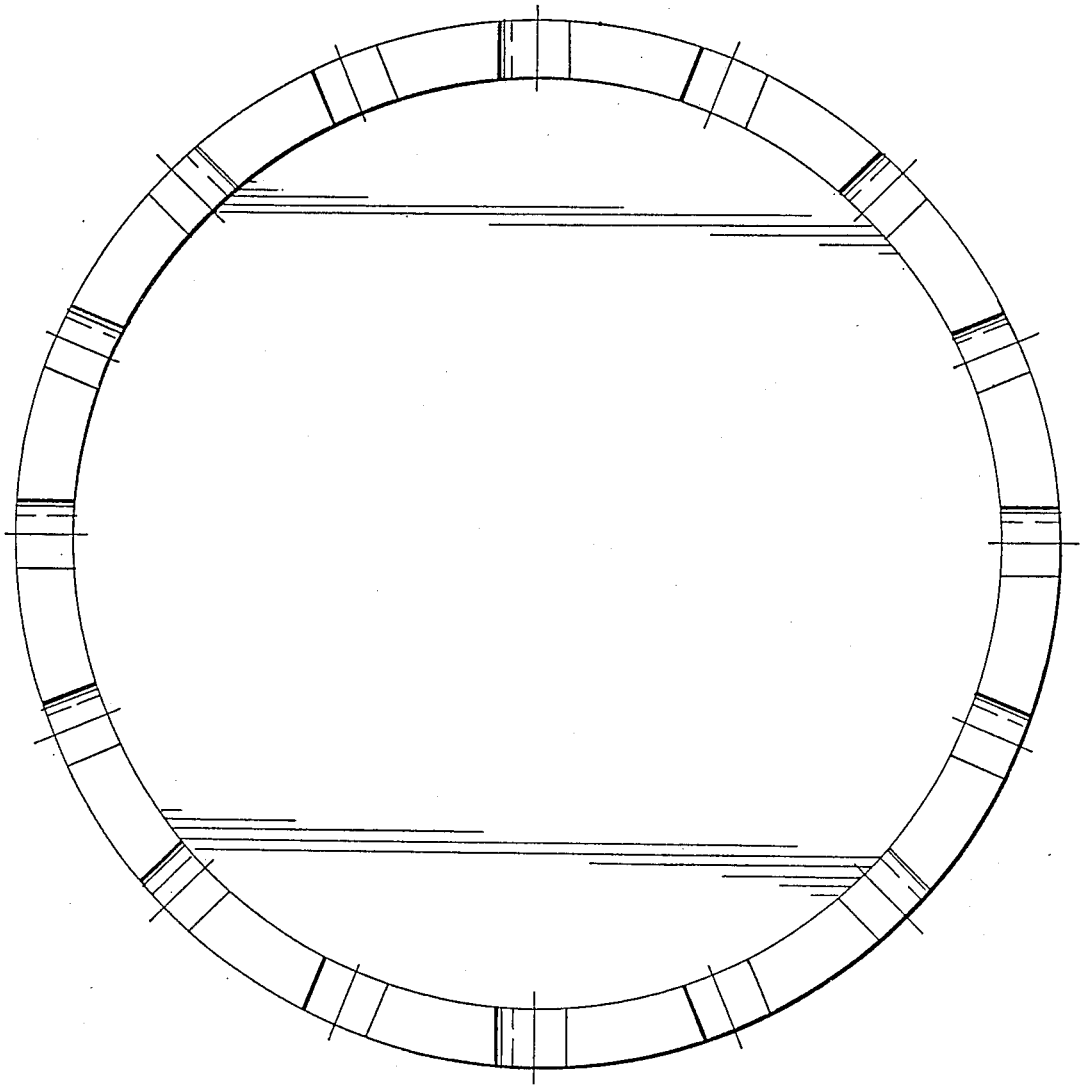
FIG. 1 is an overhead view of the base of the jig, showing the U-shaped indentations and their spacings.
Figure 2A:
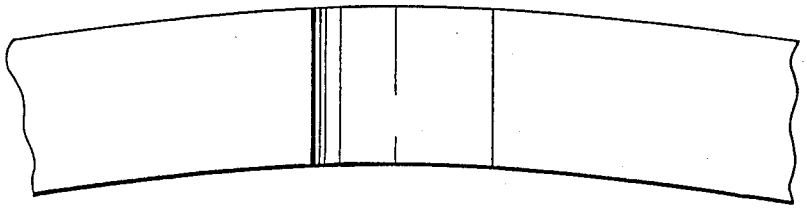
FIG. 2 is detailed lateral views of the U-shaped indentations located around rim base.
Figure 2B:
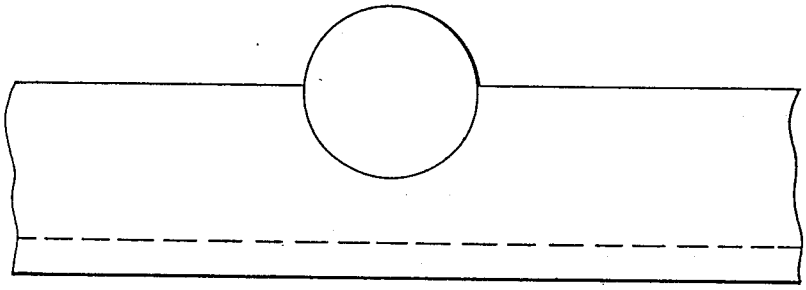
Figure 2C:
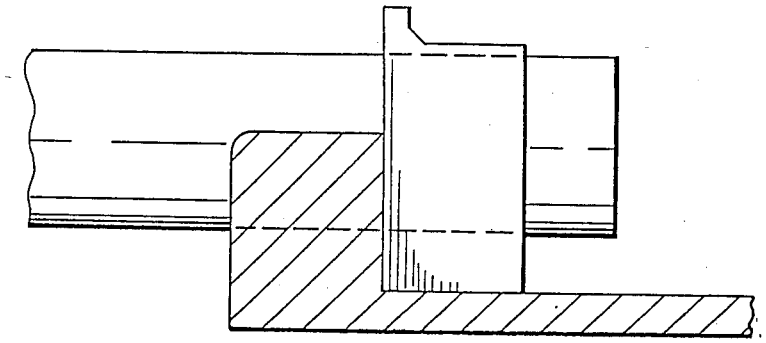
Figure 3:
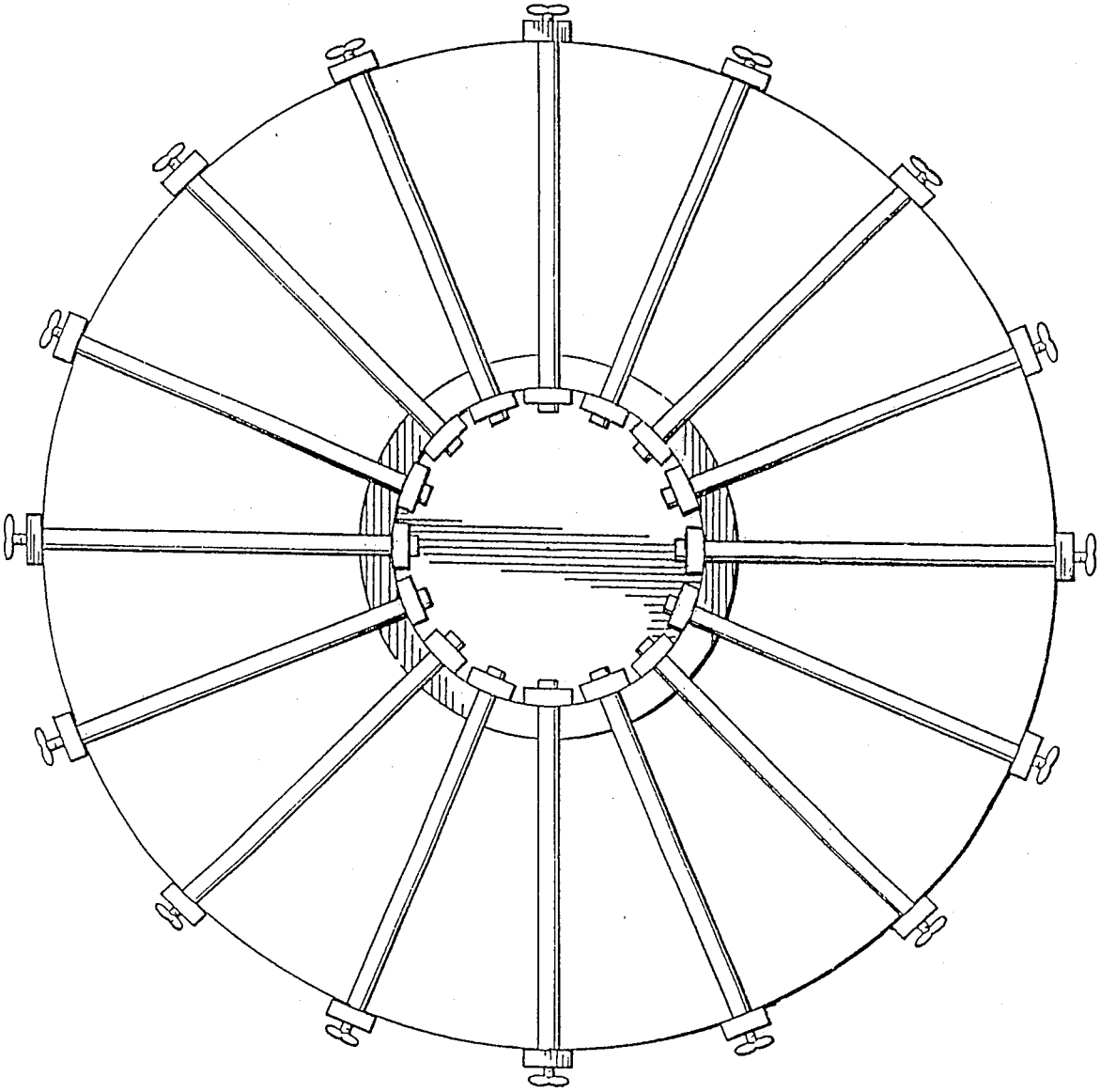
FIG. 3 is an overhead view of the entire Multipoint Clamping Jig, attached to a round tabletop.

FIG. 1 shows the U-shaped indentations, which are serially located around the rim of the base, for its entire circumference. Preferably, there are sixteen indentations on each base, with the base being eighteen inches in diameter. Each U-shaped indentation is preferably spaced equally around the circumference of the base, leaving sufficient room to accommodate sixteen U-shaped indentations. The rim of the base is preferably one inch across. Preferably, the base has a depth of one and one-quarter inches, as measured from outside edge. Although the center of the base is preferably hollow, it does not have to be completely hollow, but, rather need only be so that it can accommodate the pipe clamps and allow them to be secured to the base rim. Drawings 2 and 3 are self explanatory.

What is claimed is:

1. A multipoint clamping base, comprising in combination, the following:

(a) a round base, said base have sufficient tensil strength to withstand being pulled apart by the exertion of pressure on all sides of the base rim simultaneously, and having a number of smooth U-shaped indentations cut into the rim edge of said base, each of said U-shaped indentations being at least one and one-quarter inch in depth, and at least one and one eighth inch in length;

(b) at least two pipe clamps, each having sufficient length to reach from a point inside the rim edge of the U-shaped indentations of the base of A, to the edge of a table or object to be repaired, onto which the base of A has been placed;

(c) means to secure the pipe clamps of B to the inside edge of the base of A; and (d) means to secure the pipe clamps of B to the edge of the table or object to be repaired;

whereby the pipe clamps of B are serially placed into the U-shaped indentations of the base A, and secured, both to the inside rim edge of the base and to the edge of an object to be repaired by the means of C and D, and whereby the means of C and D are tightened sufficiently to insure that commercially available glue will properly form a bond and thereby repair the table or object to be repaired.

2. A tool for repairing oval or round table tops or other wooden objects, comprising in combination, the following:

(a) a round means having a hollow center, said means having having a number of smooth U-shaped indentations cut into the rim edge of said means, each of said U-shaped indentations being at least sufficient in breadth and depth to allow a clamping means to be held securely therein;

(b) at least two clampings means, each having sufficient length to reach from a point inside the rim edge of the U-shaped indentations of A, to the edge of a table or object to be repaired, onto which the means of A has been placed;

(c) means to secure the pipe clamps of B to the inside rim edge of the means of A; and (d) means to secure the pipe clamps of B to the edge of a table or object to be repaired;

whereby the clamping means of B are serially placed into the indentations of the means of A, and secured, both to the inside rim edge of said means of a and to the outside edge of an object to be repaired by the means of C and D, and whereby the means of c and d are tightened sufficiently to insure that commercially available glue will properly form a bond and thereby repair the table or object to the repaired.

3. The tool of either claim one or two whereby the pipe clamps of clamping means are made of metal, are three-quarter inches in diameter, and where the base is made of cast iron, having a diameter of eighteen inches.

4. The tool of either claim one or claim two wherein the pipe clamps or clamping means are one-half inches in diameter and wherein said U-shaped indentations are in the range of one and one-eighth inches to one and one-quarter inches.

5. The tool of either claim one or two wherein said base or round means is made of plastic and wherein said U-shaped indentations are in the range of one and one-eighth inches to one and one-quarter inches.

6. The tool of either claim one or two wherein said pipe clamps or clamping means are made of plasitc and wherein said U-shaped indentations are in the range of one and one-eighth inches to one and one-quarter inches.

7. The tool of either claim one or two wherein the diameter of said base is in the range of 12 to 24 ranges and wherein said U-shaped indentations are in the range of one and one-eighth inches to one and one-quarter inches.

8. The tool of either claim one or two wherein the diameter of said U-shaped indentations clamps is in the range of three-quarter inches to one and three quarter inches and wherein said U-shaped indentations are in the range of one and one-eighth inches to one and one-quarter inches.

9. The tool of either claim one or two wherein the diameter of said base or round means is in the range of 16 to 20 inches.

10. The tool of either claim 1 or 2 wherein said U-shaped indentations are in the range of one and one-eighth inches to one and one-quarter inches.

* * * * *